US005407345A

United States Patent [19]

Robertson et al.

[11] Patent Number: 5,407,345

[45] Date of Patent: Apr. 18, 1995

[54] ULTRA LOW NOX BURNER

[75] Inventors: Thomas Robertson, Cleveland; Todd Miller, Garfield Heights; Dennis Quinn, Hinckley, all of Ohio

[73] Assignee: North American Manufacturing Co., Cleveland, Ohio

[21] Appl. No.: 44,719

[22] Filed: Apr. 12, 1993

[51] Int. Cl.[6] ..... F23L 9/00

[52] U.S. Cl. ..... 431/115; 431/181; 431/278; 431/285; 431/353

[58] Field of Search ..... 431/115, 116, 9, 181, 431/351, 353, 285, 158, 278

[56] References Cited

U.S. PATENT DOCUMENTS

| | | | |
|---|---|---|---|
| 2,515,845 | 7/1950 | Van den Bussche | 431/115 |
| 4,004,875 | 1/1977 | Zink et al. | 431/9 |
| 4,629,413 | 12/1986 | Michelson et al. | 431/9 |
| 5,135,387 | 8/1992 | Martin et al. | 431/116 |
| 5,195,884 | 3/1993 | Schwartz et al. | 431/181 |
| 5,201,650 | 4/1993 | Johnson | 431/115 |

*Primary Examiner*—James C. Yeung
*Attorney, Agent, or Firm*—Jones, Day, Reavis & Pogue

[57] ABSTRACT

A burner is disclosed having a burner chamber with heavily insulated heat retaining walls and a series of off center mixer tubes located at one end thereof. A uniform concentration gas/air mixture to 50% additional fuel above the lean flammability limit coming from the mixer tubes is ignited in the burner chamber due to the recirculation of combusting gas and air back to the end of the burner chamber above auto the ignition temperature for the mixture. The particular mixture disclosed utilizes 0.55–0.7 equivalence ratio.

3 Claims, 3 Drawing Sheets

ULTRA LOW NOX BURNER

FIELD OF THE INVENTION

This invention relates to lowering NOX in industrial burner systems.

BACKGROUND OF THE INVENTION

Increasingly, environmental protection agencies and state governments are tightening down on the pollutants which are discharged from burner systems including those used in industrial furnaces. As these limits are reduced, including those for NOX and CO, it becomes more difficult for burner manufacturers and operators to meet these pollution standards.

SUMMARY OF THE INVENTION

It is an object of this invention to lower the pollutants produced by burner systems.

It is an object of this invention to improve the efficiency and temperature uniformity of combustion of burner systems.

It is an object of this invention to reduce or eliminate flashback in burner systems.

It is an object of this invention to produce a burner having low NOX and CO outputs.

It is an object of this invention to avoid the use of external gas mix plenums in low pollution burner systems.

It is an object of this invention to improve the temperature uniformity produced by burner systems.

Other objects and a more complete understanding of the invention may be had by referring to the following description and drawings in which:

DESCRIPTION OF THE PREFERRED EMBODIMENT

Figure 1:
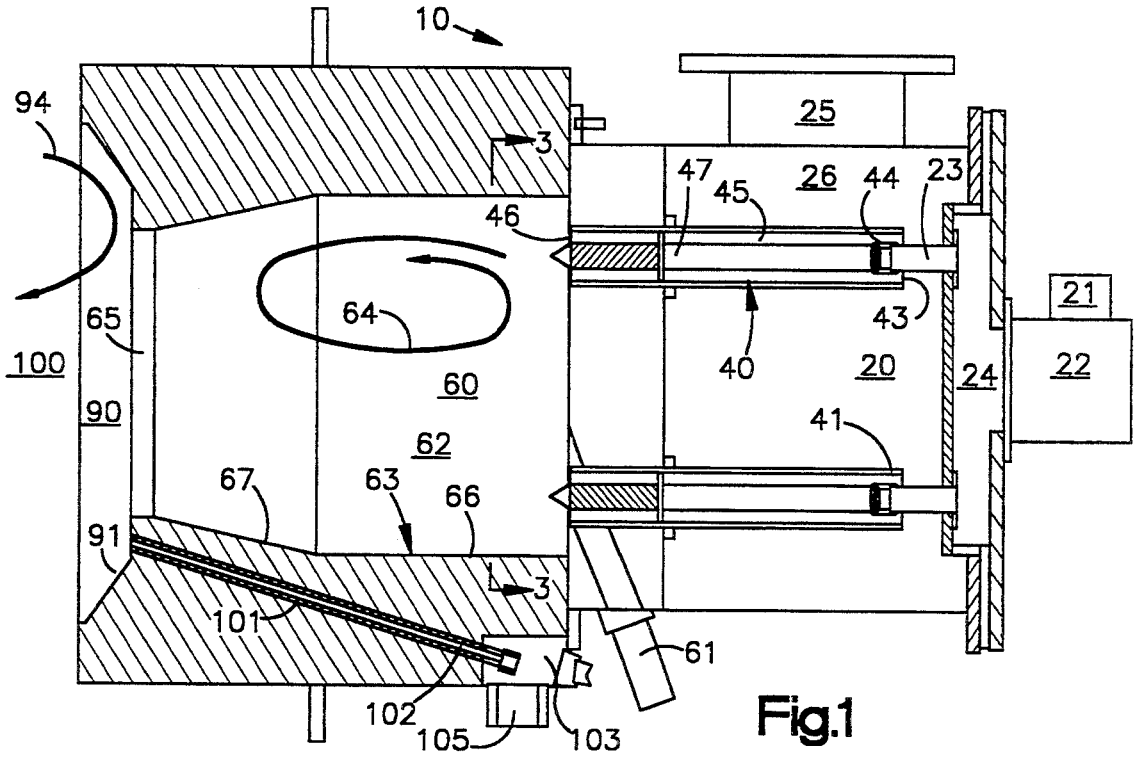
FIG. 1 is a longitudinal cross sectional view of a burner system incorporating the invention of the application.
Figure 2:
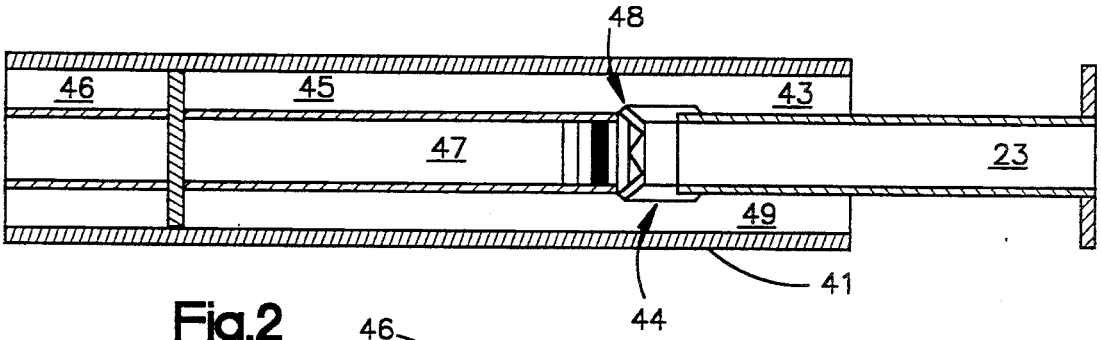
FIG. 2 is an enlarged partial cross sectional view of the mixer tube of the preferred embodiment of FIG. 1.
Figure 3:
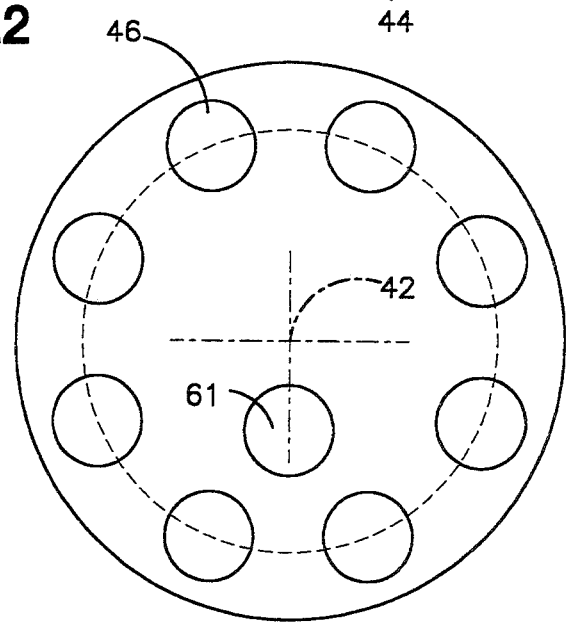
FIG. 3 is an end view of the mixer taken generally along the lines 3—3 of FIG. 1.

The disclosed design of the Ultra Low NOX Partial Premix burner consists of two modules, a mixer section and a reaction chamber/bypass gas section. The mixer section supplies a highly uniform premix near to the flammability limits to the reaction chamber, preferably with an equivalence ratio between 0.55 and 0.7, for natural gas as fuel and air as the oxidant. When combusted, these lean mixtures produce extremely low NOX emissions. The reaction chamber/bypass gas section provides a location for premix combustion, a means of decreasing overall system excess air, and flame shaping capabilities. On many applications this will be the final embodiment of the burner, however, certain specific applications may require a slightly different configuration.

The burner system 10 includes a plenum section 20, a mixing section 40, a primary burner section 60, a flame modifying section 90, and a secondary flame section 100.

The plenum section 20 is for interconnection of the burner system 10 to the supplies for fuel and oxidant for the burner.

The fuel input 21 in the preferred embodiment disclosed is fed through a fuel connection 22 to a plenum 24 in the mixing section 40 (later described). The fuel plenum serves to distribute the incoming fuel stream uniformly between individual mixer elements. This even distribution is essential to guarantee a high quality, uniform premix is obtained by the initial mixer section at the levels later described.

In the preferred embodiment disclosed, the fuel input at this location is from 940–1200 cubic feet per hour of natural gas at the standard 14" water column pressure at 70° F. Other gaseous fuels including propane, propane-/air, butane, etc. and vaporized liquids such as oil, etc. may be fired in this style of burner.

The oxidant input 25 is a source of pressurized oxidant for the burner system 10. This oxidant input 25 is directly interconnected to the plenum 26, which oxidant plenum in turn surrounds the mixing section 40 (later described). The oxidant plenum serves to distribute the incoming stream uniformly between individual mixer elements. This even distribution is essential to guarantee a high quality, uniform premix is obtained by the initial mixer section.

In that the oxidant plenum 26 is isolated from the fuel plenum 22, there is no mixing of fuel and oxidant in the plenum section 20. This avoids the explosion potential which is present if oxidant and fuel are present in a plenum or tube which is located separately from the area of actual combustion.

In the preferred embodiment disclosed, the oxidant is air with standard 21% oxygen and 16000 cubic feet per hour at 70°. In the preferred embodiment disclosed, the air pressure within the air plenum 26 is 10" water column.

Note that if the air input 25 is at a different temperature than the 70° F. described or at a different oxygen content, the volume of fuel input can be reduced or increased as necessary in order to maintain the proper ratio for the primary burner section 60 (later described), particularly in respect to the lean flammability limit. The most common way for the oxidant input 25 to be at a different temperature would be if the incoming oxidant was preheated prior to being mixed with the fuel. This could be occasioned by the use of a recuperator, as for example item 300 in FIG. 5 which is interconnected between the furnace and the stack 301, by a regenerator, or a secondary burner in the air input lines, or otherwise as desired. Preferably the change from ambient oxidant to preheated oxidant would be accompanied by two changes to the primary burner module. First, as the inlet oxidant temperature is raised, a corresponding increase in the reaction chamber temperature will occur. To maintain minimum NOX levels, this increase in oxidant temperature would be offset by a corresponding decrease in the primary zone equivalence ratio. Additionally, a refractory lining would be added to the module to maintain a low burner shell temperature. If 1000° F., 21% $O_2$ preheated air is furnished to the burner for example, the primary zone equivalence ratio would preferably be lowered to 0.445 from 0.65 for ambient air. Bypass gas passages and the reaction chamber exit diameter may also have to be modified for optimum burner performance. It is preferred that the temperature preheating means raise the temperature of the mixture fed to the burner section with a temperature increase below the ignition temperature of the fuel/oxygen mixture (i.e. normally on the range of 1200° F.). This would reduce the risk of premature ignition at a location other than the primary burner section 60.

Note that increasing the oxygen content of the combustion oxidant such as air also will raise the primary zone adiabatic flame temperature. Similar to preheated oxidant, this increase in flame temperature would be compensated for by a decrease in primary zone equivalence ratio.

The mixing section 40 is designed to provide a uniform concentration of mixed oxidant and fuel at a uniform velocity at the head end of the burner section 60 (i.e. at the ends of both individual mixing tubes) and between individual mixing tubes. It is also designed to avoid the potential for flashback into the mixer and into the chamber. The output of the mixing section is a uniform fuel oxidant mixture having a ratio from the lean flammability limit to 50% excess fuel from this lower limit. The flammability ratio is described in *Combustion Theory* by Forman A. Williams (also incorporated page 266 for example). This limit is set forth as:

"Flammability limits are limits of composition or pressure beyond which a fuel oxidizer mixture cannot be made to burn".

The flammability limit is a complex function of fuel composition, oxidant composition, mixture pressure, and mixture temperature which cannot always be readily calculated. It is the intent of this invention that the primary combustion zone equivalence ratio be maintained as close as possible to the flammability limit on either side thereof, allowing for reasonable ratio control. For this reason, an operating range for the primary zone equivalence ratio is specified as being between the flammability limit and the midpoint of the flammability limit and stoichiometric ratio. This provides for reasonable control of the burner system through a variety of firing rates.

The mixing section 40 accomplishes the intimate mixing of both primary fuel and oxidant streams such that the resultant mixture has a high degree of uniformity. When the mixers are properly spaced at the entrance to the reaction chamber, the ensuing reacted mixture has only minimal NOX levels. Typical mixture ratios and NOX levels are as follows:

| Equivalence Ratio | NOX Emissions |
|---|---|
| .55 | 2.9 ppm v at 3% O2 |
| .60 | 4.3 ppm v at 3% O2 |
| .65 | 6.6 ppm v at 3% O2 |
| .70 | 10.8 ppm v at 3% O2 |

The equivalence ratio generally is the fuel air ratio divided by the stoichiometric fuel air ratio.

In the preferred embodiment disclosed, the mixing section 40 includes a series of eight tubes 41 extending in a circle spaced from the central axis 42 of the burner system 10. Each mixer tube 41 of the preferred embodiment includes an intake 43, an inspirator 44, a mixer 45, and a discharge 46. All of the mixer tubes are fed from a common fuel plenum 24 and a common oxidant plenum 26. This avoids the necessity of multiple plenums or interconnections.

Figure 7:
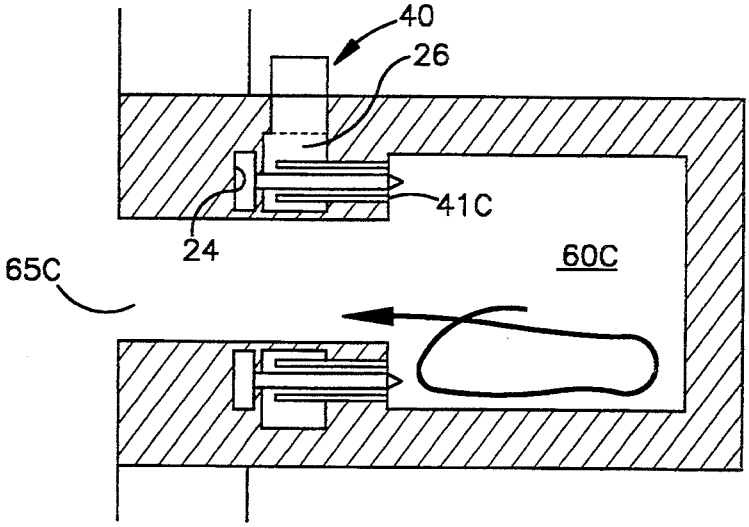

The preferred mixers 41 are placed on a common bolt circle with sufficient spacing both between individual mixer exits and between the collective mixer exits radius and the circle center to provide high levels of recirculation. The preferred mixing section 40 of FIG. 1 further provides a flow imbalance so as to cause a reverse flow or recirculation within the later described primary burner section 60. This pulls heat back to the face of the location of input of the incoming fuel oxidant mixture to facilitate ignition and uniform burning (later described). In the preferred embodiment shown, this location is the discharge of the mixing section 40 at the inlet of the primary burner section 60 with the recirculation primarily due to the arrangement of the later described mixing tubes 41 within the mixing section 40. The location of discharge could be relocated (even, for example, to near the outlet of the primary burner section as in FIG. 7) with other methods of recirculation to draw the heat back to the discharge. The reason for this is the desirability of drawing heat back to the discharge is more important than the location of the discharge or the cause of the recirculation, which drawing heat back promotes auto ignition and assists in combustion stability of the lean mixtures. As set forth, other types of mixers, locations, and recirculation means could also be used.

The intake 43 of the mixer tubes 41 is fed directly from the oxidant plenum 26. Oxidant such as air thus passes freely through these intakes 43.

An entrance section 49 is located between the intake 43 and the inspirator 44. This section 49 serves to straighten the incoming oxidant flow and spread it uniformly throughout the mixer tube 41 annulus. The inspirator 44 itself includes a series of holes 48 extending through tubes 23 to the primary fuel plenum 24. The inspirator 44 thus utilizes a high fuel exit velocity through holes 48 to uniformly draw an oxidant through the entrance section 49 from the intake 43. Intimate mixing of the fuel and oxidant occur downstream in the mixing section 45. The annular passageway of the mixing section 45 serves two purposes. First, it increases mixer tube 41 length to diameter ratio, accomplishing complete mixing of the fuel and oxidant in the shortest possible distance. The annular shape also provides mixer flashback prevention by increasing the flow velocity and maintaining passage sizes below the quenching diameter for the given mixture. In the preferred embodiment disclosed, the velocity through the mixing section 45 is approximately 140 ft/s.

The mixing section 45 of each mixer tube 41 serves to combine the fuel and oxidant to provide a uniform concentration mix of the two at a uniform velocity. This is not only within any individual mixer tube 41, but is also true between various separate mixer tubes 41.

In the preferred embodiment, each mixer tube 41 is a tube some 2" in diameter having a 11" total length. The entrance section 49 has a diameter of some 1.25" with the eight holes 48 for each mixer tube having a 0.9375" diameter section spaced 60° F. from each other.

Figure 5:
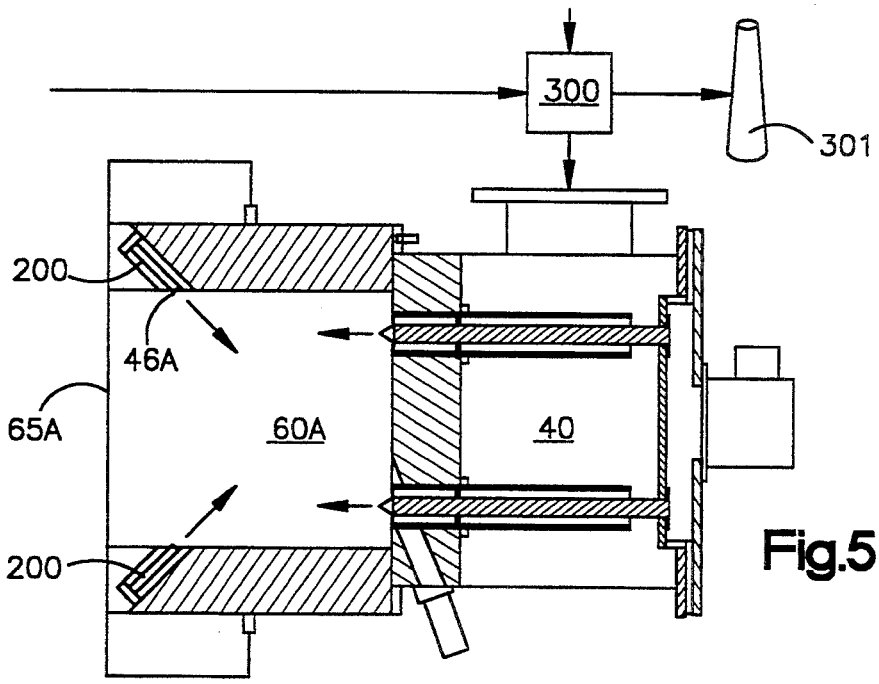
Figure 6:
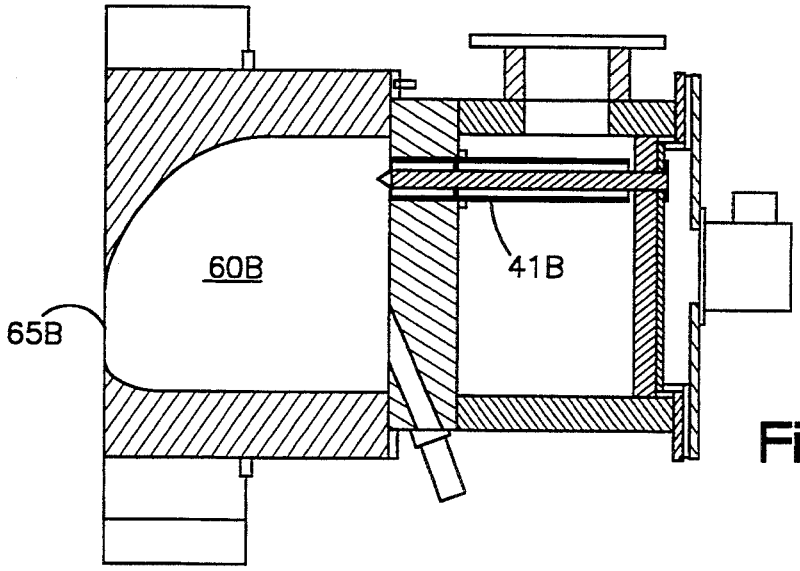

The discharge 46 from the mixing section 40 is directly into the primary burner section 60. In the preferred embodiment, in order to provide a reverse recirculation flow to pull heat back to the mixer, the location of the discharges 46 of the mixer tubes 41 are at the inlet to the primary burner section 60, and selected to provide for a recirculating flow imbalance within the reaction chamber. In the preferred embodiment, this is provided by locating the discharge 46 of the mixing tubes 41 off center a significant distance from the axis 42 of the burner system 10. This provides the necessary flow imbalance in the primary burner section 60 in order to recirculate hot gases and thus draw heat back to the discharges 46 of the mixer. This facilitates the operation of the burner by auto igniting the fuel and oxidant and providing for uniform combustion temperatures. The mixing section 40 thus serves to stabilize the combustion in the primary burner section 60 as well as aiding in the recirculation flow in such primary burner section 60. The discharges from each mixer tube 41 also have a location in respect to the surrounding walls 63 of the primary burner section 60. The location is preferably selected to provide for a slight eddy type back flow recirculation along the walls 63. This would aid in the auto ignition without unduly subjecting the walls 63 to high temperatures or creating wall temperature losses (which one wants to minimize). The net effect of the recirculation within the primary burner section 60 is that a flow of combusting materials having a temperature above the ignition temperature of the incoming fuel oxidant mixture exists, which flow passes to the location of input of such incoming fuel oxidant mixture. Auto ignition therefore will occur, outlet volumes, wall losses, and other factors not withstanding. This ignition means is self sustaining (although possibly after the inclusion of supplementation by a pilot 61, the burner walls 63 or other heat storage/additive device). Note again that other mixer designs and locations may be utilized. For example, in certain applications, smaller burner designs in particular, one integral mixer feeding several mixer ports through an intermediate plenum and/or piping could be utilized, the ports on the same pattern as individual mixers on other, normally larger burners. Other designs could also be utilized to provide the described uniform fuel oxidant mix. Other recirculation means could also be utilized in order to draw the heat back to the discharge of the mixing section. Two examples are shown in FIGS. 5 and 6. In FIG. 5, a secondary mixer assembly 200 is located near the outlet 65A of the primary burner section 60A with the tube discharge 46A of the secondary mixer assembly 200 being directed generally towards the inlet of such burner section 60A. This reverse direction discharge recirculates the combusting fuel oxidant mixture within the burner section 60A. By varying the fuel oxidant ratio between the main mixer 40 and secondary mixer 200, fuel or oxidant staging could be provided. In addition, flue gas could also be utilized in this secondary mixer assembly 200. In FIG. 6, the mixer tubes 41B are located asymmetrically in respect to a revised burner section 60B having a conical shape designed to aggressively promote recirculation during combustion.

The recirculation of combusting fuel and oxidant within the primary burner section 60, however it is provided, provides auto ignition and combustion of the uniform fuel oxidant mixture coming from the discharges 46 of the mixer tubes 41 by drawing heat to such discharge at a temperature above the ignition temperature of the fuel oxidant mixture. This aids in the complete combustion of the fuel oxidant mixture, something important at or near the described lean flammability ratios utilized in this burner.

The primary burner section 60 is the area in which virtually all of the primary combustion for the burner system 10 occurs. The preferred primary burner section 60 disclosed is designed to have a heat retentive insulated wall with a thermal characteristic to assist in maintaining an even temperature within the primary burner section 60. In the preferred embodiment, the walls 63 of the primary burner section 60 also have a thermal mass to assist in maintaining a temperature above the flammability limit and more particularly the ignition temperature of the described gas/air mixture. While this thermal mass could also be designed to have properties, such as a mass, sufficient to be used by itself to ignite the fuel oxidant mixture in the reaction chamber, it is preferred that some other ignition means be utilized, in the preferred embodiment primarily recirculation of combusting gases. The reason for this is a combination of the desire to have a compact burner (high thermal mass walls add size and insulation demands) as well as tightening down control of the burner (high thermal mass walls operate differently on cold start up than on hot running for example).

The entrance diameter of the inlet of the primary burner section is designed to provide a low velocity eddy recirculation of combusting products back to the input fuel and oxidant mix to develop and sustain ignition (the mix is also thermally stabilized via the wall heat transfer). The preferred primary burner section 60 accomplishes ignition on start up by actuating a pilot burner 61 to provide a heat source having the necessary ignition temperature (and also possibly enriching the mixture with extra fuel to assist in the initial ignition). The location of the pilot 61 near the axis 42 of the burner facilitates uniform ignition. After recirculation of combusting gases back to the inlet is well established to sustain the combustion, the pilot 61 is preferably turned off. At this time (about 20 seconds for a cold start up), the burner chamber recirculation 64 set up by the location of the mixer tubes 41 in the preferred embodiment serves to maintain a very stable burn in the primary burner section 60. The heat from the walls 63 of the primary burner section 60 aids in maintaining the combustion within the primary burner section 60. Optionally, the pilot 61 can be used for ignition on start up and then backed down to a lean burn to assist in the continued ignition of the fuel oxidant mixture or otherwise modified as desired. Although the pilot can be included as a start up, then optional supplemental ignition means for the burner during operation, other sources of heat, for example glow wires, could be utilized.

The particular burner section 60 shown includes a reaction chamber 62, a surrounding wall 63, an inlet and an outlet 65.

The wall 63 of the primary burner section 60 is a heavily insulated high temperature wall. This aids in facilitating the previously set forth combustion in the primary burner section 60. In the preferred embodiment disclosed, it is designed to maintain the temperature of approximately 1400°-2300° F. upon stabilization of the combustion within the reaction chamber 62. The wall 63 includes a cylindrical section 66 and the cylindrical outlet 65 interconnected by a tapering section 67. The tapering section 67 provides a gradual contraction at the outlet of the primary combustion chamber insuring a complete burnout of the premix. The tapering section is also part of the later described flame modifying section.

The cylindrical reaction section 66 is the primary combustion area for the burner. This section accomplishes the combustion of the primary fuel oxidant mixture. Lean premix mixtures enter the chamber from the mixers and are initially pilot ignited. Stability of the flame is obtained primarily by recirculation of partially combusted gases back to the incoming non-combusted oxidant fuel mixture. The reaction chamber has a significant impact on the flame shaping and momentum. In the burner system disclosed, an intermediate flame length and intermediate velocity are created by the use of a small taper at the chamber exit. This also prevents the flow of any furnace gases back into the recirculation paths within the reaction chamber. The design parameters of the reaction chamber are cold flow space velocity (14 exchanges/sec), mean cold flow entrance velocity (15–20'/s), and hot flow exit velocity (180'/s). Other flame shapes can be provided by altering the reaction chamber design and most particularly the shape of the tapering section.

The particular cylindrical section 66 disclosed is approximately 8" in diameter and 10" in length. Reaction chamber dimensions will be adjusted to the change in volume flow for the calculated stoichiometry. Bypass passages and exit ports could also be changed. As set forth, the tapering section 67 serves to facilitate the recirculation 64 for the reaction chamber 62 as well as aiding in the shaping of the flame. This section 67 could be omitted if desired. In the preferred embodiment disclosed, the tapering section is approximately 4" in overall length and a 40° included angle taper. Due to the existence of the reduced diameter, the recirculation of gases at 2000°–2300° F. within the reaction chamber back to the discharge 46 of the mixer tubes 41 is facilitated. This high temperature recirculation (caused primarily by the off balance mixer section in the preferred embodiment) in combination with the pilot and the heat of the wall 63 serves to maintain the combustion within the reaction chamber. The outlet section 65 is approximately 6" in diameter and 1" in length. The outlet section 65 is the main output for the primary burner section 60. The air has a velocity of 35–400' per second, some 180' per second in the preferred embodiment through this outlet section 65. The pressure of the outlet 65 of the primary combustion chamber 60 is preferably from 0.5–4" water column.

The equivalence ratio in the primary burner section 60 is from 0.5 to 0.75 for natural gas and air combustion. The oxygen content is from 10 to 6.5%.

There is a slight flame in this outlet section 65 in the preferred embodiment disclosed. This flame facilitates ignition with the bypass gas (as later described). This flame could be eliminated or expanded as desired (along with the bypass gas). Note that in some unusual circumstances the primary burner section 60 might be utilized as a furnace.

Figure 4A:
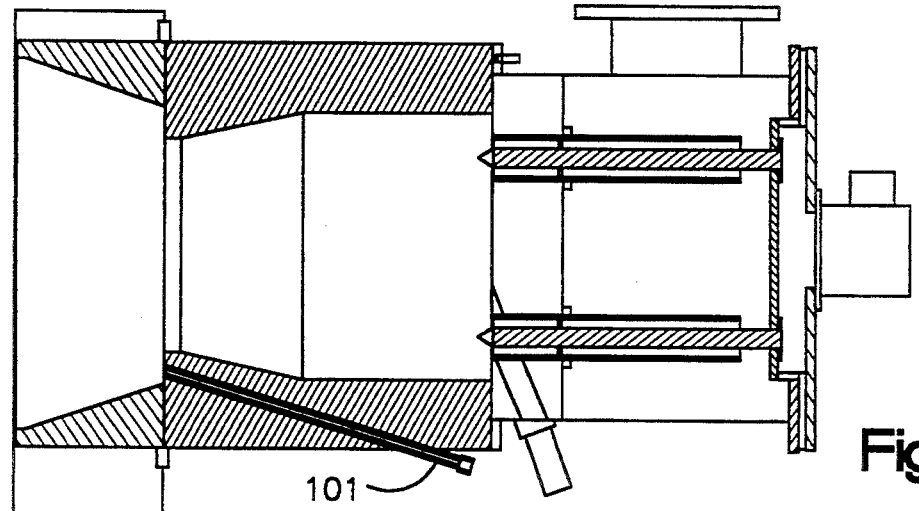
FIG. 4 is a series of longitudinal cross sectional views of modified burner systems like FIG. 1; and, FIGS. 5, 6, and 7 are longitudinal cross sectional views of further burner systems incorporating the invention.
Figure 4B:
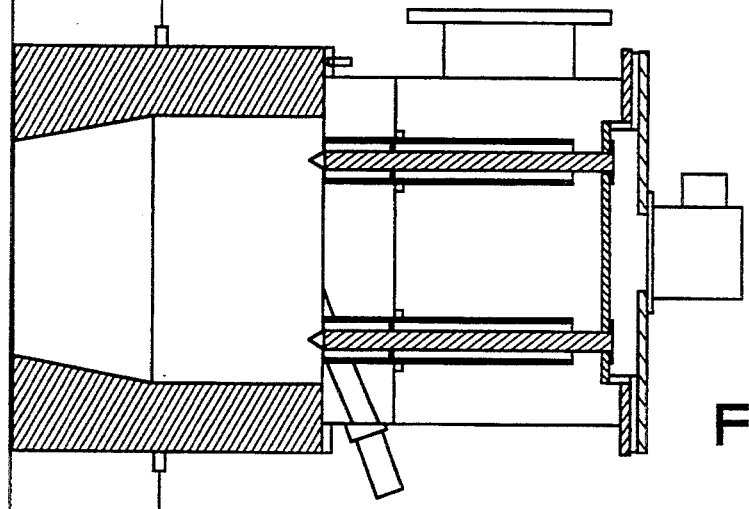
Figure 4C:
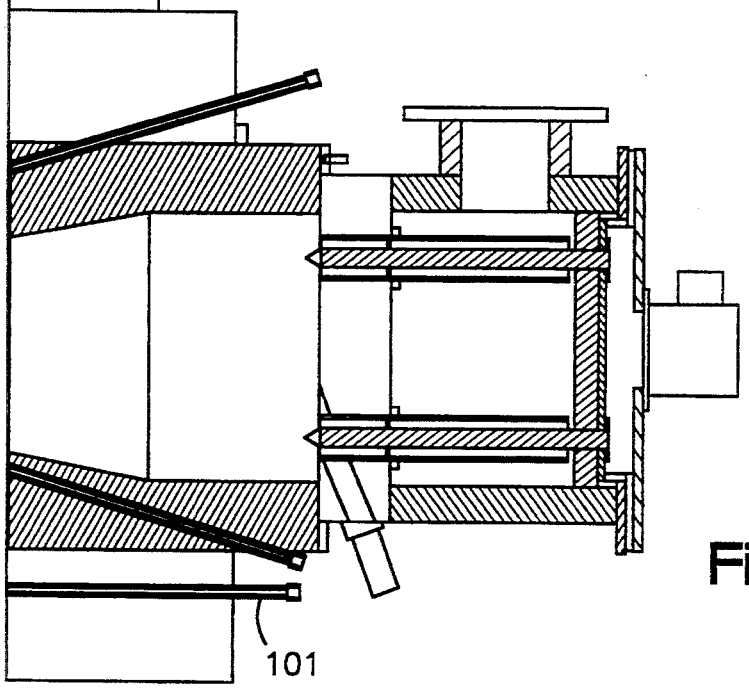

The optional flame modifying section 90 for the burner system is designed to work in conjunction with the primary burner section 60 (most particularly the tapering section 67) in certain select applications to shape the flame of the bypass gas burning in the furnace 100. For example, the flame modifying section 90 shown is a burner tile 91 some 6" in length having a gradual taper. This burner tile guarantees burning in a cold furnace. (It would not be needed in a hot furnace like a glass or steel reheat furnace which could use a system like that in FIG. 4*b*.) The purpose for this particular flame modifying section is to clean up carbon monoxide output in a cold furnace application (it may reach 200 parts per million or more in a cold furnace while only 10 parts per million above 1400° F.). The flame modifying section 90 also aids in the recirculation within the furnace as later described.

In the preferred embodiment disclosed, there are a series of secondary bypass gas jets 101 located circumferentially surrounding the outlet 65 of the primary burner section 60. These optional secondary gas jets are used to provide burning within the flame modifying section 90 of the burner and the secondary flame section 100 (later described). This type of combustion is desirable for example in boiler, process heater, and aluminum melting and holding burners.

The optional secondary flame section 100 is a location for secondary burning. The preferred embodiment uses entraining jets to draw furnace gases back to the burner, thus diluting combustion. This secondary burning occasions some NOX penalty, but this is compensated for by an increase in the heat liberated from the primary burner section 60.

The secondary fuel combination section may consist of the final furnace tile and the bypass fuel jet exits. These two features serve three purposes in the combustion system; they increase the final heat liberation to normal industrial heating levels (2% O2 in the flue gas), they define flame shape and aesthetic appearance, and they provide the final control of NOX and CO emissions. The preferred design utilizes jets well spaced from the reaction chamber, angled toward the centerline of the burner at 10°–15° F., and a short furnace tile section. This combination produces both NOX and CO emission levels below 20 ppm v (3% O2 basis) in a 1600° F. chamber. The resultant flame shape is compact with a tight diameter and an axial heat release with ambient air of approximately 1 MMBTU/hr-ft.

In the preferred embodiment disclosed, the secondary flame section 100 is activated by a series of bypass fuel (gas) jets 101 which are located surrounding the outlet section 65 of the primary burner section 60. The bypass fuel jets 101 are fed through a series of tubes 102 from a secondary fuel plenum 103, a plenum fed from its own fuel input 105 in the preferred embodiment disclosed. The secondary fuel plenum serves to distribute the fuel stream uniformly between the individual bypass passages. This even distribution gives the visible flame balance and consistency through the flame envelope. This separate gas input 105 allows the individual control of the secondary flame section. These bypass gas jets 101 provide gas (from 40–700' per second and 300–600 cubic feet per hour in the preferred embodiment shown) in order to provide a medium temperature burning (in excess of 1200° F. in the preferred embodiment shown) within the furnace. They also entrain furnace gases to dilute the combustion process. This stages the burning of the fuel in the secondary flame section. This eliminates flame quenching and reduces carbon monoxide generation (also providing a 3' flame into the furnace in the preferred embodiment). The furnace recirculation 94 aids in this secondary flame burning. In the preferred embodiment disclosed, the NOX is substantially 18 ppm, 7 ppm carbon monoxide for 1600° F. furnace temperature, and a 2,500,000 btu burner. It is preferred that the distance, angle and velocity of the bypass gas jets 101 be selected such that the burning of the gas bypass is complete at a temperature above 1400° F. With lower furnace temperatures, this will necessitate a closer location of the gas jets 101 to the outlet 65 than in a furnace having a temperature above this 1400° F. In certain situations such as those able to take direct burner output (for example, the 8% O2), the secondary jets may be eliminated and no bypass gas would be utilized. For example, aggregate dryers typically run at approximately 7% O2 dry in the products of combustion. To obtain the lowest possible NOX emissions, no bypass gas will be utilized. Additionally, some manufacturers use an extra combustion chamber to complete combustion, minimizing carbon monoxide emissions due to flame quenching by the drying process. In these applications, no reaction chamber/bypass gas section will be required. The primary burner element will mount directly to the combustion chamber, using it as the reaction chamber.

Combustion product gases may be recirculated to either of two locations. If it is included with the combustion air, a decrease in primary zone adiabatic flame temperature will result. This must be offset by a corresponding increase in primary zone equivalence ratio. Also the reaction chamber and bypass gas port dimensions may have to be changed to accommodate the difference in flow rates. The second option for the addition of product gases is through the bypass gas ports. If this method is used, changes must be made to the bypass gas supply passages and exit ports.

Although the invention has been described in its preferred form with a certain degree of particularity, it is to be realized that numerous changes may be made without deviating from the invention as herein after claimed.

As an example, although a particular design of mixing tube 41 is disclosed for the mixing section 40, other means of uniformly intermixing the fuel and combustion air could be utilized instead.

As an additional example, although the primary burner section 60 is disclosed having a tapered section 67 interconnecting the cylindrical section 66 and the outlet 65, and the flame modifying section 90 has a tapering section 91, other types of reduction in diameters could be utilized including an abrupt transition. Other modifications are also possible to suit various application.

What is claimed:

1. A burner system for combusting fuel with an oxidant, the mixture having an ignition temperature, the burner comprising a reaction chamber, said reaction chamber having an inlet and an outlet, a uniform mixing means to uniformly mix the fuel with the oxidant up to 50% additional fuel above the lean flammability limit, said mixing means including a series of mixing tubes located about the axis of the reaction chamber and spaced there from at the inlet thereof, said mixing tubes including an inlet and a discharge, an oxidant plenum, said oxidant plenum being connected to said inlet of said mixing tubes so as to provide oxidant thereto, a fuel plenum, an inspirator for each mixing tube, said inspirator for each mixing tube being located within said mixing tube between said inlet and said discharge respectively, said inspirator being connected to said fuel plenum, said mixing tubes passing a uniform mixture of oxidant and fuel to the inlet of said reaction chamber, said discharge of said mixing tubes being located off center with respect to said inlet of said reaction chamber so as to recirculate part of the combusted uniformly mixed fuel and oxidant mixture back to said inlet of said reaction chamber, ignition means to maintain a temperature above the auto ignition temperature of the fuel and oxidant mixture, said ignition means including the recirculation of part of the combusted uniformly mixed fuel and oxidant mixture back to said inlet of said reaction chamber, secondary bypass gas jets, said secondary bypass gas jets being located adjacent to said outlet of said reaction chamber, means to connect said bypass gas jets to a source of fuel, and said bypass gas jets providing secondary fuel to said combusted fuel and oxidant mixture coming from said outlet of said reaction chamber.

2. A burner system for combusting fuel with an oxidant, the mixture having an ignition temperature, the burner system comprising a reaction chamber, said reaction chamber having an inlet section and an outlet section, a uniform mixing means to uniformly mix the fuel with the oxidant up to 50% additional fuel above the lean flammability limit, said uniform mixing means including an oxidant plenum, said oxidant plenum being connected to a source of oxidant, a fuel plenum, said fuel plenum being connected to a source of fuel, said uniform mixing means including a series of mixing tubes located about the axis of the reaction chamber spaced therefrom at the inlet section thereof, said mixing tubes having an inlet opening into said oxidant plenum, said mixing tubes having an inspirator, said inspirator being connected to said fuel plenum, said mixing tubes having a discharge, said discharge of said mixing tubes being located at said inlet section of said reaction chamber, said inspirator of said mixing tubes being located between said inlet and said discharge of said mixing tubes, ignition means for maintaining a temperature greater than the auto ignition temperature of said mixed input fuel and oxidant to combust same, said ignition means including said mixing tubes being located off balance in respect to said reaction chamber so as to recirculate some of the products of combustion within said reaction chamber to said inlet section, and said outlet section of said reaction chamber being connected to a furnace.

3. A burner system for combusting fuel with an oxidant, the mixture having an ignition temperature, the burner system comprising a reaction chamber, said reaction chamber having an inlet section and an outlet section, a uniform mixing means to uniformly mix the fuel with the oxidant up to 50% additional fuel above the lean flammability limit, said uniform mixing means being connected to said inlet section of said reaction chamber, said mixing means including a fuel input and an oxidant input and mixing tubes, said mixing tubes providing a uniform concentration of oxidant and fuel to said inlet section of said reaction chamber, ignition means for maintaining a temperature greater than the auto ignition temperature of said mixed input fuel and oxidant to combust same, said ignition means including said mixing tubes being located off balance in respect to said reaction chamber so as to recirculate some of the products of combustion within said reaction chamber back to said inlet section, said outlet section of said reaction chamber being connected to a flame modifying section, said flame modifying section being located at said outlet section of said reaction chamber, secondary bypass gas jets, said secondary bypass gas jets being located within said flame modifying section, means to connect said bypass jets to a fuel plenum, and said secondary bypass gas jets providing secondary fuel to the fuel oxidant mixture departing said reaction chamber through said outlet section.

* * * * *